United States Patent [19]

Roccaforte

[11] Patent Number: 4,580,709

[45] Date of Patent: Apr. 8, 1986

[54] DISPENSING CARTON HAVING MATERIAL TEAR STRIP AND BLANK THEREFOR

[75] Inventor: Harry I. Roccaforte, Western Springs, Ill.

[73] Assignee: Champion International Corporation, Stamford, Conn.

[21] Appl. No.: 334,444

[22] Filed: Dec. 24, 1981

[51] Int. Cl.[4] ..... B65D 85/671

[52] U.S. Cl. ..... 225/48; 225/91; 493/86; 493/378

[58] Field of Search ..... 225/91, 92, 48, 50; 493/86, 378

[56] References Cited

U.S. PATENT DOCUMENTS

| | | | |
|---|---|---|---|
| 1,843,429 | 2/1932 | Marcalus | 493/86 |
| 1,939,812 | 12/1933 | Hamersley | 225/91 X |
| 2,316,469 | 4/1943 | Thor | 225/48 |
| 2,628,179 | 2/1953 | Bergstein | 225/48 X |
| 3,567,087 | 3/1971 | Schramm | 225/91 X |
| 3,974,947 | 8/1976 | Budny | 225/49 X |
| 3,986,440 | 10/1976 | Macdonald et al. | 225/49 X |
| 4,371,104 | 2/1983 | Korte | 225/48 |

*Primary Examiner*—Frank T. Yost

*Attorney, Agent, or Firm*—Evelyn M. Sommer

[57] ABSTRACT

The paperboard carton has a material severing edge which is located on an end edge of the blank from which the carton is formed and is used to sever material from a roll thereof disposed in the carton. The material severing edge is preferably located at the lower front corner of the carton and projects beyond the plane of the front wall of the carton. The material severing edge is preferably a plastic strip secured to the paperboard and having a cutting surface formed concurrently with the formation of the end edge of the blank on which it is mounted. The paperboard backing the cutting surface is preferably substantially removed from beneath the cutting surface so that the latter consists essentially of all plastic.

14 Claims, 15 Drawing Figures

DISPENSING CARTON HAVING MATERIAL TEAR STRIP AND BLANK THEREFOR

This invention relates to paperboard cartons of the type adapted for holding a roll of continuous sheet material which material is withdrawn and dispensed from the carton. More particularly, this invention relates to such cartons which are provided with serrated material cutting edges for severing the dispensed sheet material into usable sheets of various sizes.

It is well known in the prior art to provide folded paperboard cartons which contain rolls of sheet material and from which selected sized sheets of the material are dispensed. The free edge of the sheet is grasped and pulled out of the carton to unwind the roll, and when an appropriate amount has been removed, the sheet is severed from the rest of the roll, usually by means of a cutting edge on the carton. Materials such as wax paper, plastic wrap, metal foil, and the like are commonly dispensed in this manner. Dispensing cartons of this general type are disclosed in U.S. Patent Application Ser. Nos. 227,685, filed Jan. 23, 1981 to Ralph J. Korte; 270,486, filed June 4, 1981 to Ralph J. Korte; 299,958, filed Sept. 8, 1981 to Harry I. Roccaforte; and 305,618, filed Sept. 25, 1981 to Harry I Raccaforte. The serrated cutting strip may be positioned on the bottom wall of the carton projecting forward beyond the plane of the front wall, or it may be positioned on the lower free edge of the front hood panel of the carton. The cutting strip may be a metal or plastic strip which is secured to the carton wall.

This invention relates to such a paperboard dispensing carton wherein the cutting strip is a serrated plastic strip bonded to one edge of the paperboard blank prior to performing the carton folding operations, and where the cutting strip is positioned on the lower front edge of bottom wall of the carton with the cutting teeth projecting beyond the plane of the front wall of the carton. Another aspect of this invention relates to the manner in which the plastic cutting strip is mounted on the edge of the paperboard, and particularly to the fact that the paperboard underlying the serrations or teeth on the cutting strip is removed or skived off so that effectively the severing operation is performed by the exposed plastic cutting teeth of the cutting strip. This form of cutting strip has been found to produce a cleaner, sharper and easier severing of polyethylene film wrap dispensed from the carton as compared to the prior art plastic cutting strip wherein the paperboard underlying the plastic cutting teeth is also serrated and is coexistant with the plastic cutting teeth.

It is, therefore, an object of this invention to provide a paperboard carton adapted to dispense and sever sheets of material from a roll of the material disposed in the carton.

It is a further object of this invention to provide a carton of the character described which is provided with a plastic cutting edge secured to a free edge of the blank from which the carton is formed.

It is an additional object of this invention to provide a carton of the character described wherein the paperboard underlying the cutting teeth of the plastic cutting edge is substantially removed to expose the plastic material for severing the material being dispensed.

It is yet another object of this invention to provide a carton of the character described wherein the cutting edge is disposed at the front corner of the bottom wall of the carton with the cutting teeth projecting beyond the plane of the front wall of the carton.

It is an additional object of this invention to provide a blank for forming a carton of the character described.

These and other objects of the invention will become more readily apparent from the following detailed description of preferred embodiments of cartons formed in accordance with this invention when taken in conjunction with the accompanying drawings, in which.

Figure 1:
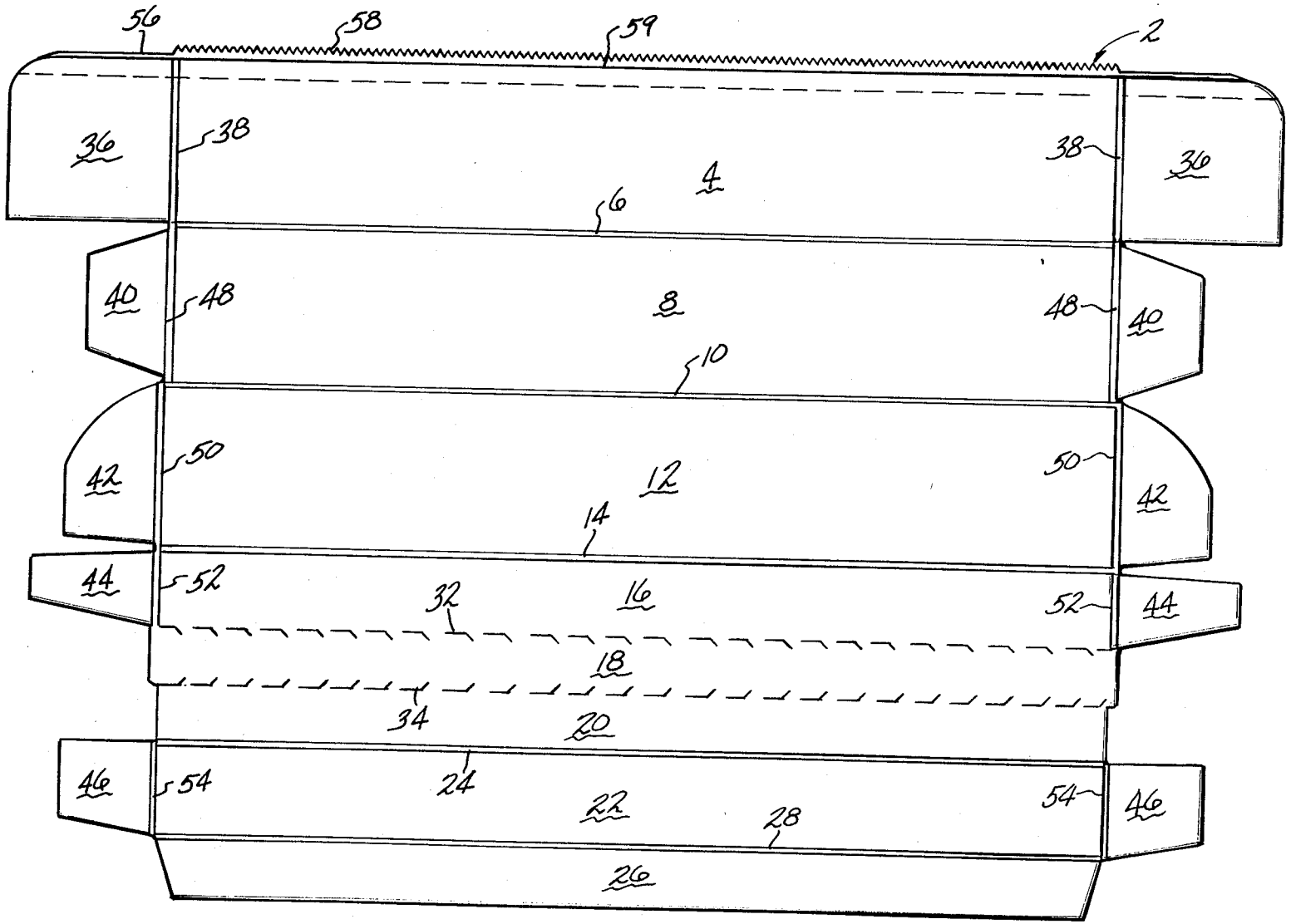
FIG. 1 is a plan view of a precut and scored paperboard blank from which a first preferred embodiment of a carton formed in accordance with this invention can be made.

Referring now to the drawings, there is disclosed in FIG. 1 a preferred embodiment of a precut and scored paperboard blank, denoted generally by the numeral 2, from which a preferred embodiment of a dispensing carton formed in accordance with this invention can be erected. The blank 2 includes a bottom wall panel 4 connected by means of a score line 6 to a back wall panel 8. The back wall panel 8 is connected by means of a score line 10 to a top wall panel 12, which, in turn, is connected by means of a score line 14 to a hood panel 16. A transverse tear strip 18 extends across the blank 2 adjacent to the hood panel 16, and adjacent to the tear strip 18 there is disposed a compound front wall panel formed by an outer panel 20 foldably connected to an inner panel 22 by means of a score line 24. A reinforcement flap 26 is foldably connected to the inner panel 22 by means of a score line 28. It will be noted that the tear strip 18 is bounded by a pair of parallel interrupted cut score lines 34 and 32. A pair of end closure flaps 36 are foldably connected to opposite ends of the bottom wall panel 4 by means of score lines 38, and similarly, end closure flaps 40, 42, 44 and 46 are foldably connected to opposite ends of the back wall panel 8, the top wall panel 12, the hood panel 16, and the inner front wall panel 22 by means of score lines 48, 50, 52, and 54 respectively. A plastic cutting edge 56, having cutting teeth 58 is secured to the outer surface of the bottom wall panel 4 by means of a suitable adhesive or the like. The cutting edge 56 is secured to the edge of the blank 2 before the edge is finally cut. When the final cut is made, the edge 56 is serrated by the use of a serrated cutting tool such that the underlying paperboard is also serrated. The edge of the underlying paperboard blank is then skived or peeled away from the line 59 so that about 90% of the paperboard backing is removed from the serrated portion 58 of the cutting edge 56. This leaves basically only the plastic serrations to perform the severing operation on the sheet material being withdrawn from the carton. It has been found that this type of cutting edge makes for cleaner, sharper and easier severing of polyethylene film wrap material when the latter is dispensed from the carton.

Figure 2:
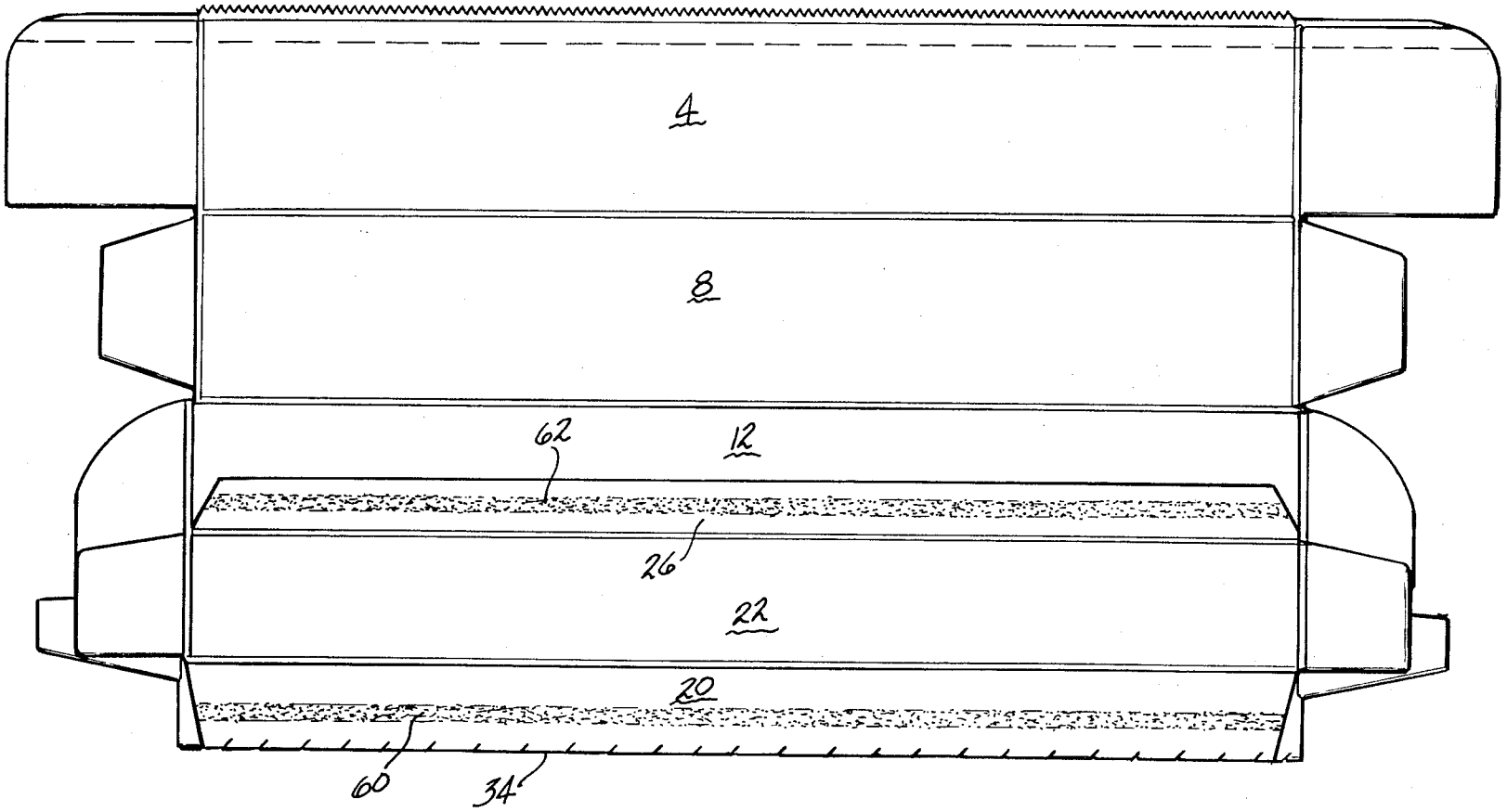
FIG. 2 is a plan view showing the first folding operation for the blank of FIG. 1 preparatory to forming a flattened form of the carton.
Figure 3:
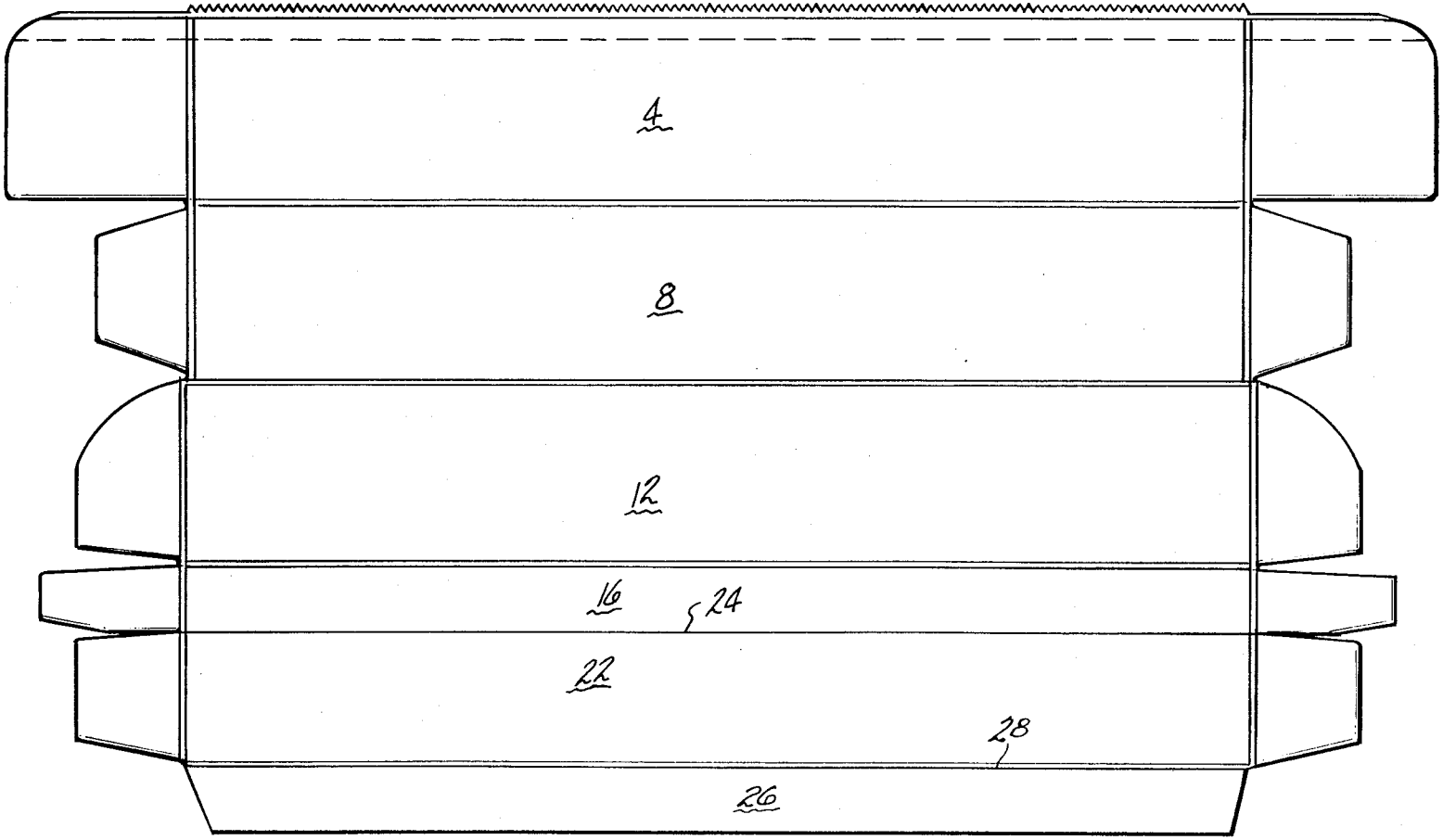
FIG. 3 is a plan view showing the second folding operation for the blank of FIGS. 1 and 2 for forming the flattened form of the carton.
Figure 4:
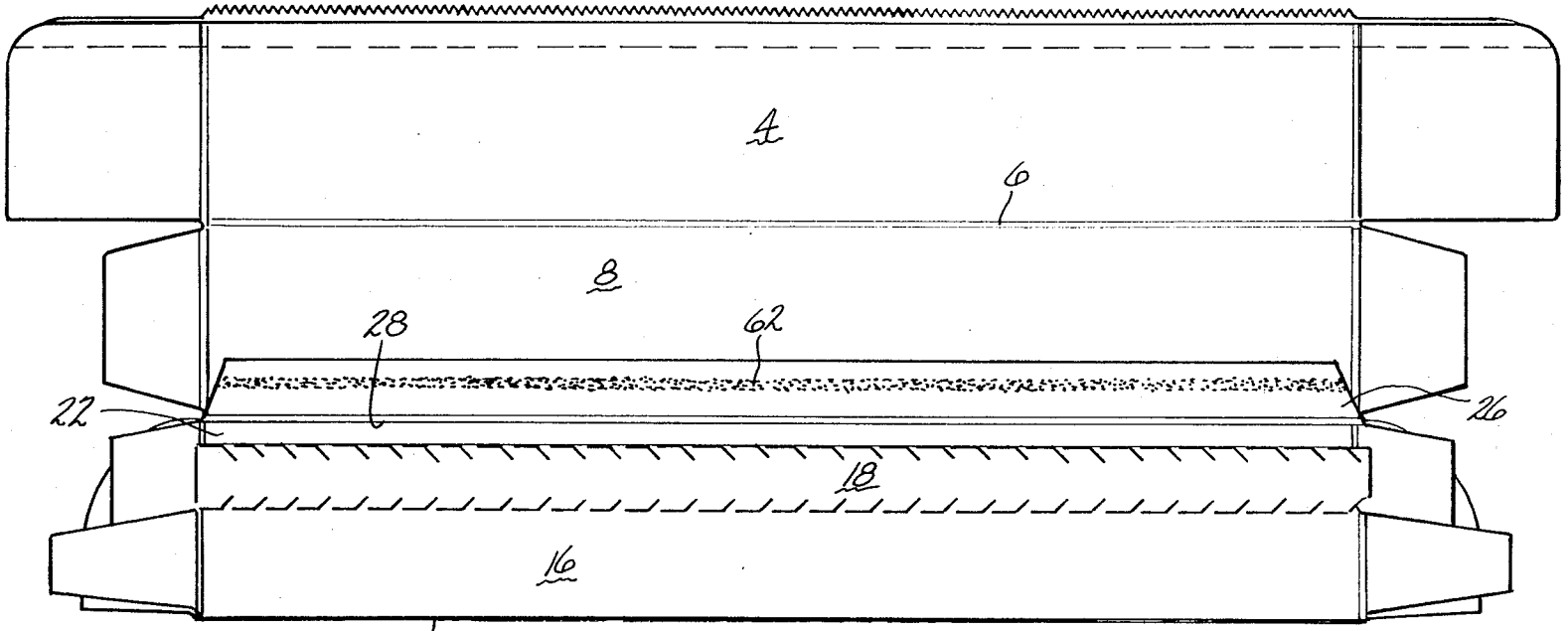
FIG. 4 is a plan view showing the third folding operation for the blank of FIGS. 1–3.
Figure 4A:
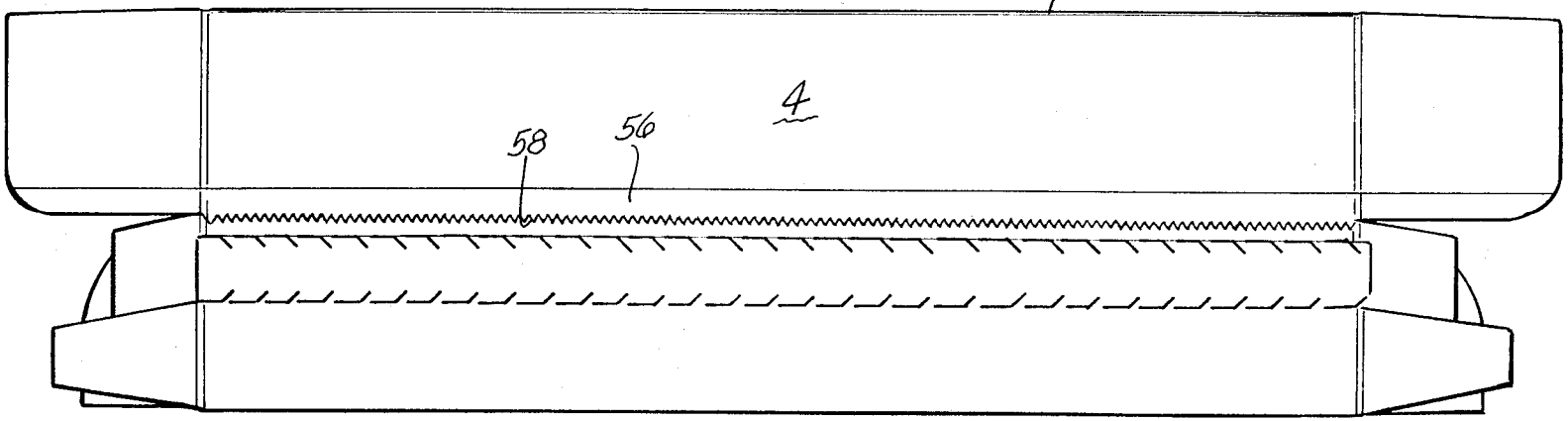
FIG. 4A is a plan view showing the final folding operation for the blank of FIGS. 1–4 whereby the flattened form of the carton is produced.

Referring now to FIGS. 2–4, the folding sequence is shown whereby the blank 2 is folded and glued to form the flattened bulk shipping form of the carton of this invention. The first folding operation is shown in FIG. 2, and consists of folding the outer panel 20, the inner panel 22, and the reinforcement flap 26 about the interrupted cut score line 34 so as to overlie the top panel 12. Adhesive strips 60 and 62 are applied to the outer panel 20 and reinforcement flap 26. As shown in FIG. 3, the second folding step involves folding the inner panel 22 back about the score line 24 whereby the inner panel 22 will adhere to the outer panel 20 by means of the adhesive strip 60. The hood panel 16, tear strip 18 and reinforcement flap 26 are then folded about the score line 14, as shown in FIG. 4 whereby the adhesive strip 62 is re-exposed. As shown in FIG. 4A, the final folding step to form the flattened carton involves folding the bottom wall panel 4 about the score line 6 so as to bring the bottom wall panel 4 into overlying engagement with the reinforcement flap 26 whereby the adhesive strip 62 will secure the bottom wall panel 4 to the reinforcement flap 26. In this form the serrated cutting edge 56 has its teeth 58 projecting beyond the score line 28 which connects the reinforcing flap 26 to the inner panel 22. It will be noted that the score line 28 forms the bottom front corner of the erected carton.

Figure 5:
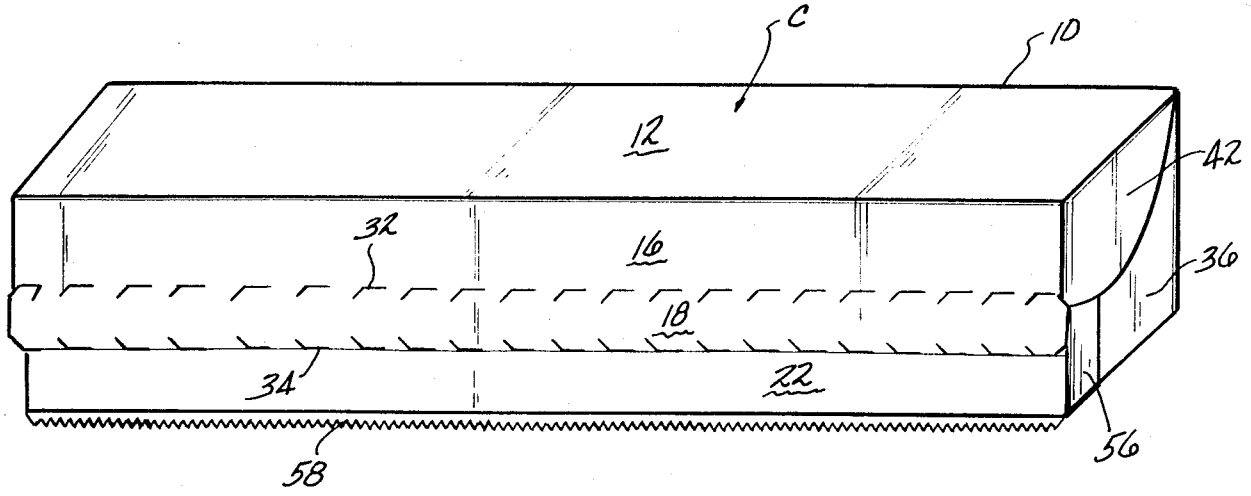
FIG. 5 is a perspective view of the erected closed carton formed from the blank of FIGS. 1–4.

Referring now to FIG. 5, the carton is shown in its erected form. It will be noted that the tear strip 18 serves to join the hood panel 16 to the inner front panel 22 via the outer front panel 20 which underlies the tear strip 18 and is connected thereto by the interrupted cut score line 34. The projecting of the cutting edge serrations 58 beyond the plane of the inner front panel 22 is also clearly shown. The end flaps 36 and 42 are appropriately folded and glued in place to close the ends of the carton. It will be appreciated that the top panel 12, hood panel 16, and end flaps 42 combine to form a cover C for the carton which is pivotally connected to the remainder of the carton by the score line 10.

Figure 6:
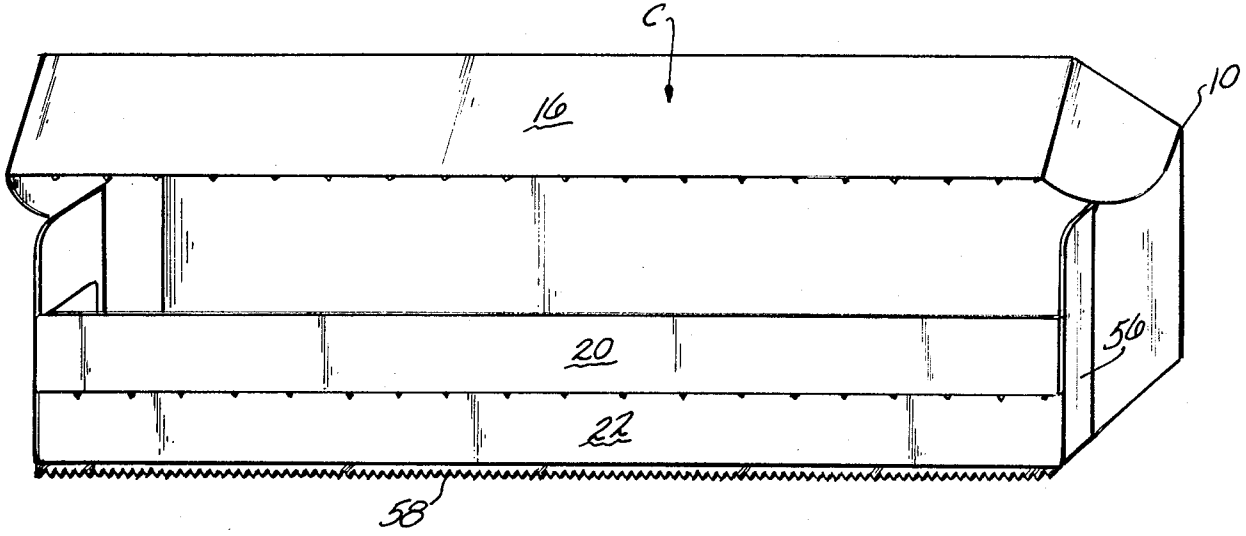
FIG. 6 is a perspective view of the carton of FIG. 5 showing the latter with the tear strip removed and the lid opened to permit withdrawal of the sheet material from a roll thereof disposed in the carton.

To open the carton, the tear strip 18 is pulled away from the carton rupturing the interrupted cut score lines 32 and 34 thereby eliminating the connection between the cover C and the front panel 20, 22 so as to allow the cover C to be pivoted upward about the score line 10 to the position shown in FIG. 6. When the carton is thus opened, the sheet material in the carton can be pulled out unwinding the roll, and when a sufficient amount has been withdrawn, it can be severed from the roll by drawing it across the protruding serrated teeth 58.

Figure 7:
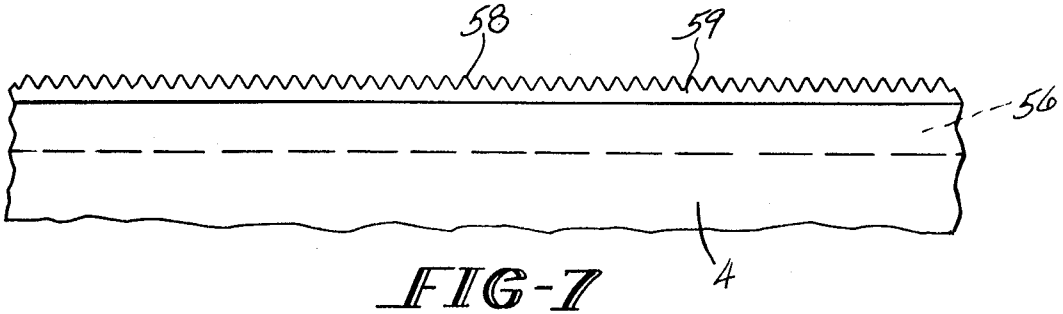
FIG. 7 is a plan view of the inner surface of the edge of the carton blank on which the cutting strip is secured showing the manner in which the paperboard backing beneath the cutting teeth of the plastic cutting strip is removed.

Referring now to FIG. 7, there is shown an enlarged view of the manner in which the cutting edge 56 is mounted on the bottom panel 4 at the edge thereof. As previously noted, when the cutting edge 56 is adhered to the edge of the bottom panel 4, the serrated cutting teeth 58 are formed by a serrated cutting instrument so that the underlying paperboard material is also serrated in a coextensive manner with the serrated cutting teeth 58. In order to improve the operation of the cutting edge 56, the underlying serrated paperboard is removed from beneath the cutting teeth by skiving or peeling the paperboard serrations off back to the line 59 shown in FIG. 7. In the skiving operation, about 90% of the thickness of the paperboard is removed, leaving only about 10% of the paperboard behind, adhered to the underside of the cutting teeth 58. Thus, in essence, only the plastic cutting teeth 58 are left to perform the material severing operation.

Figure 8:
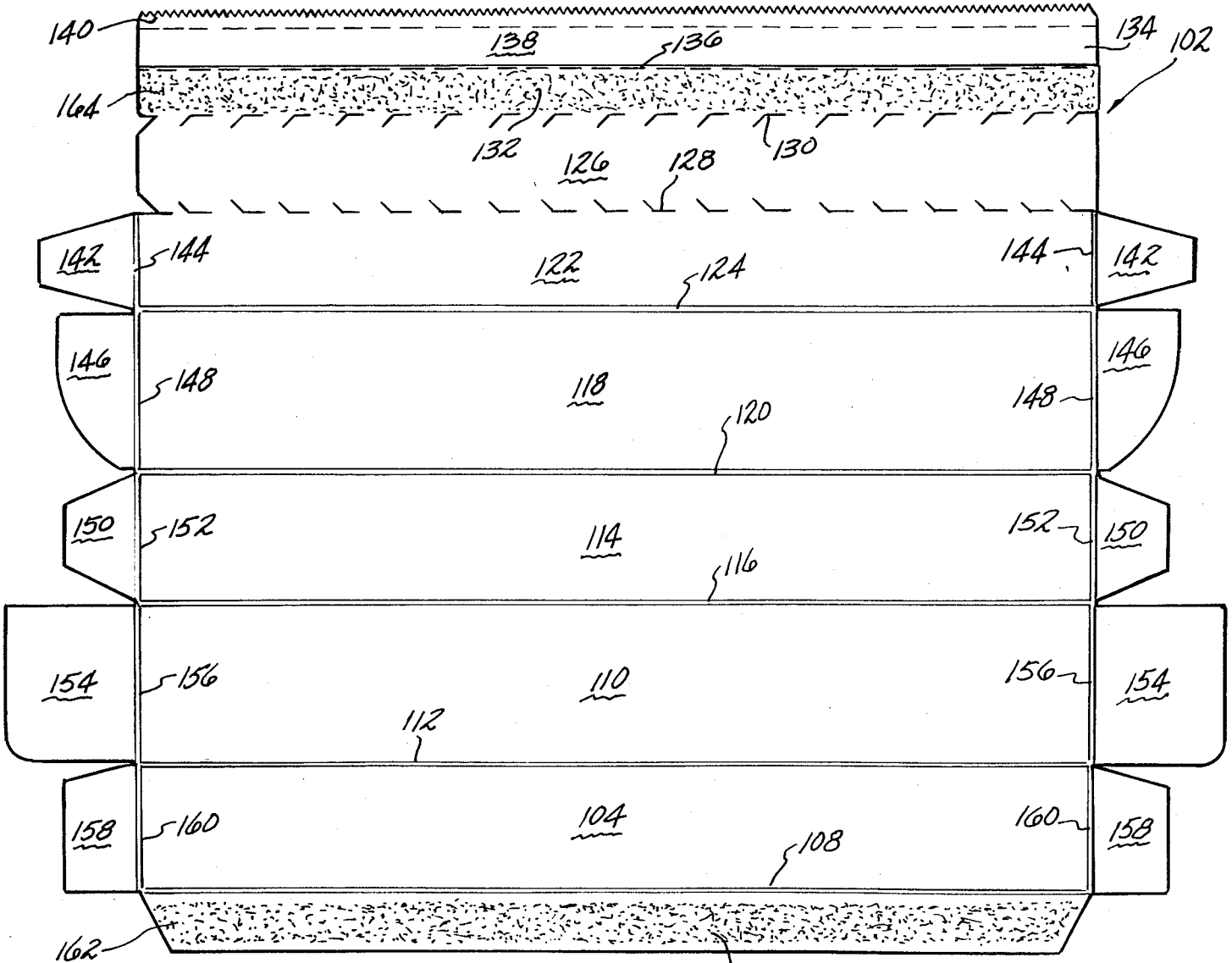
FIG. 8 is a plan view of a precut and scored paperboard blank from which a second preferred embodiment of a carton formed in accordance with this invention can be made.

Referring now to FIG. 8, there is shown a second embodiment of a blank from which an alternative embodiment of the carton of this invention is formed. The blank, denoted generally by the numeral 102, includes a front wall panel 104 having a reinforcing flap 106 foldably connected thereto by means of a score line 108. A bottom wall panel 110 is foldably connected to the front wall panel 104 by a score line 112, and a back wall panel 114 is foldably connected to the bottom wall panel 110 by a score line 116. A top wall panel 118 is foldably connected to the back wall panel 114 by a score line 120 and a hood panel 122 is foldably connected to the top wall panel 118 by a score line 124. A tear strip 126 is connected to the hood panel 122 by an interrupted cut score line 128, the opposite edge of the tear strip 126 being defined by a second interrupted cut score line 130. A glue flap 132 is foldably connected to the tear strip 126 by the interrupted cut score line 130 and a cutting edge panel 134 is foldably connected to the glue flap 132 by an interrupted cut score line 136. A polyethylene cutting edge 138 is adhered to the cutting edge panel 134 and is provided with serrated teeth 140. The paperboard beneath the serrated teeth is skived off, in the manner previously described.

The hood panel 122 has end closure flaps 142 foldably connected thereto by score lines 144, the top panel 118 has end closure flaps 146 foldably connected thereto by score lines 148, the back panel 114 has end closure flaps 150 foldably connected thereto by score lines 152, the bottom wall panel 110 has end closure flaps 154 foldably connected thereto by score lines 156, and the front wall panel 104 has end closure flaps 158 foldably connected thereto by score lines 160. The first step in erecting the carton is to apply strips of adhesive 162 and 164 to the reinforcing flap 106 and the glue flap 132 respectively.

Figure 9:
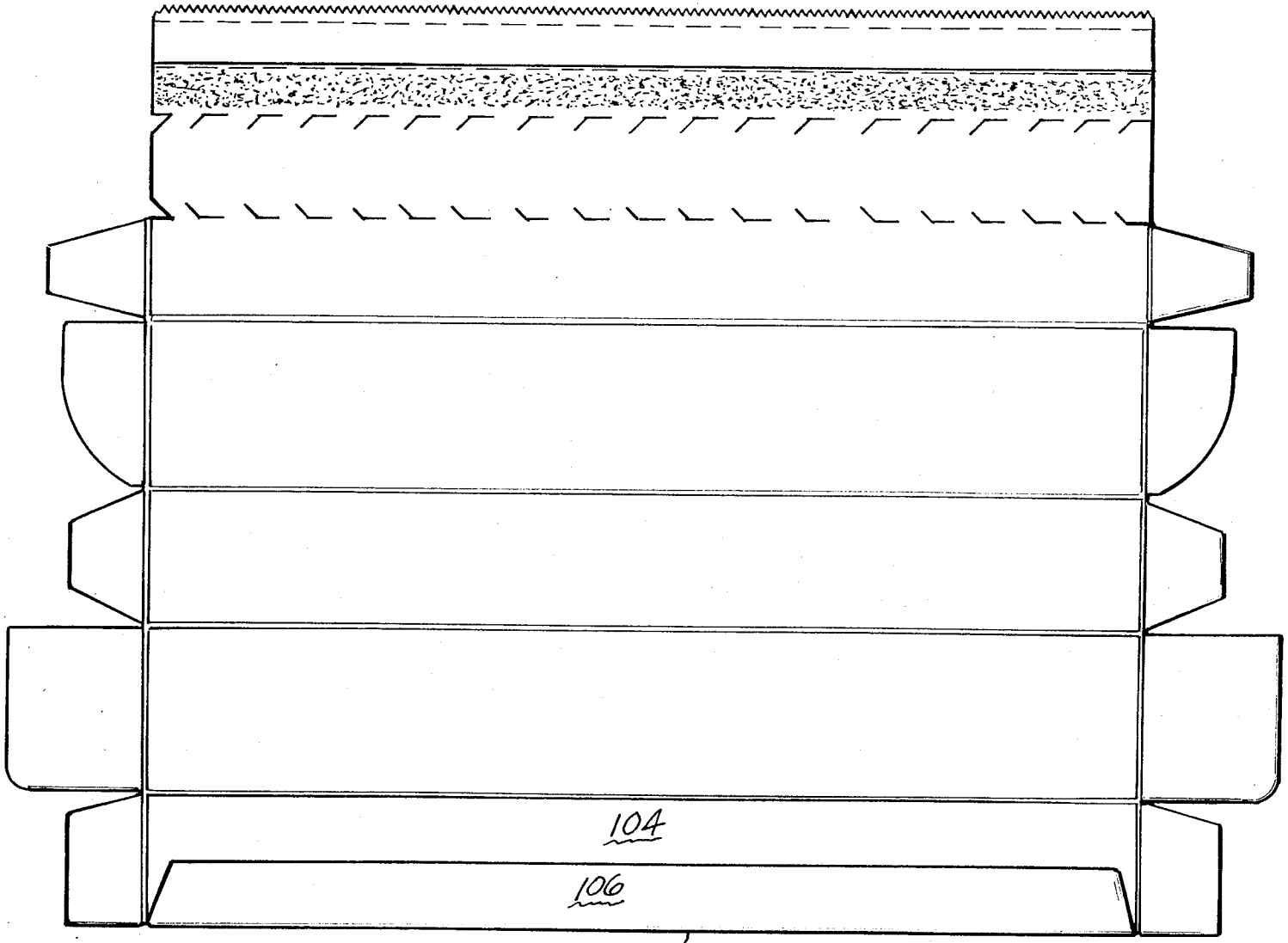
FIG. 9 is a plan view of the blank of FIG. 8 showing the first folding operation preparatory to forming the flattened form of the carton.
Figure 10:
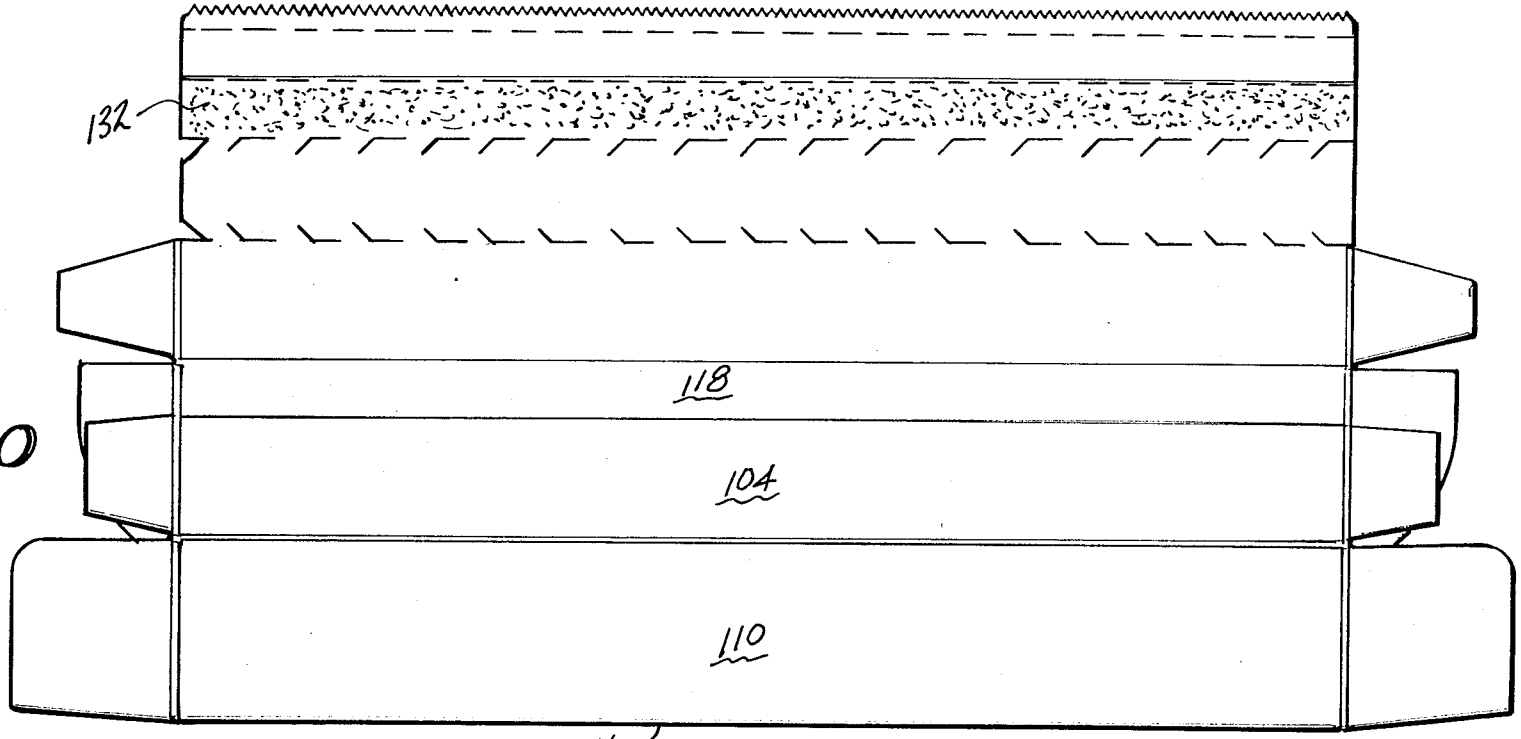
FIG. 10 is a plan view of the blank of FIGS. 8 and 9 showing the second folding operation in forming the flattened form of the carton.
Figure 11:
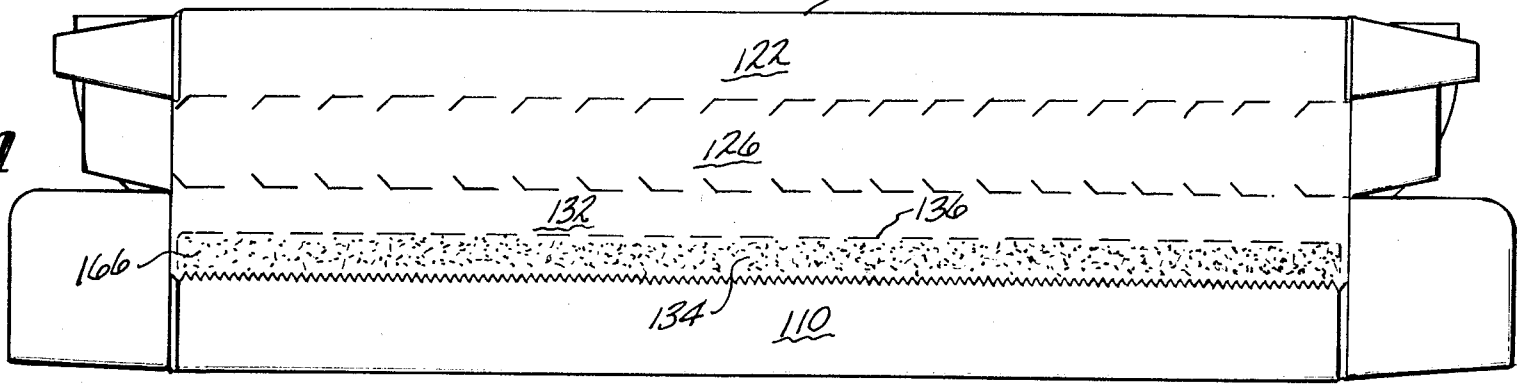
FIG. 11 is a plan view of the blank of FIGS. 8–10 showing the third folding operation in forming the flattened form of the carton.
Figure 12:
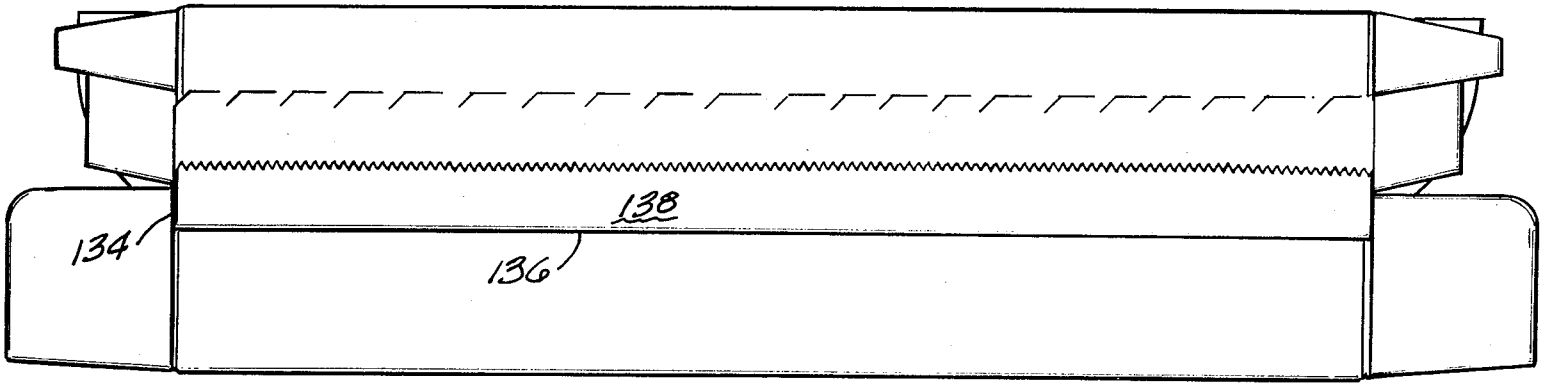
FIG. 12 is a plan view of the flattened form of the carton formed from the blank of FIGS. 8–11 after the final folding operation has been performed.

The folding sequence for forming the flattened shipping form of the carton is shown in FIGS. 9–12. In the first folding step, the reinforcing flap 106 is folded about the score line 108 to overlie and be adhered to the front wall panel 104, by reason of the adhesive strip 162, as shown in FIG. 9. The front and bottom wall panels 104 and 110 are then folded over the back and top wall panels 114 and 118 about the score line 116, as shown in FIG. 10. The hood panel 122 and tear strip 126 are then folded about the score line 124 to overlie the bottom wall panel 110 whereupon the adhesive strip 164 serves to secure the adhesive flap 132 to the bottom wall panel 110, as shown in FIG. 11. An adhesive strip 166 is then applied to the cutting edge panel 134 and the cutting edge panel 134 is then folded back about the interrupted cut score line 136 to overlie and adhere to the adhesive flap 132, as shown in FIG. 12. The form of the carton shown in FIG. 12 is the flattened bulk shipping form.

Figure 13:
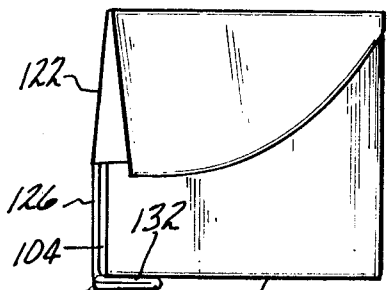
FIG. 13 is an end elevation of the erected carton formed from the blank of FIGS. 8–11.
Figure 14:
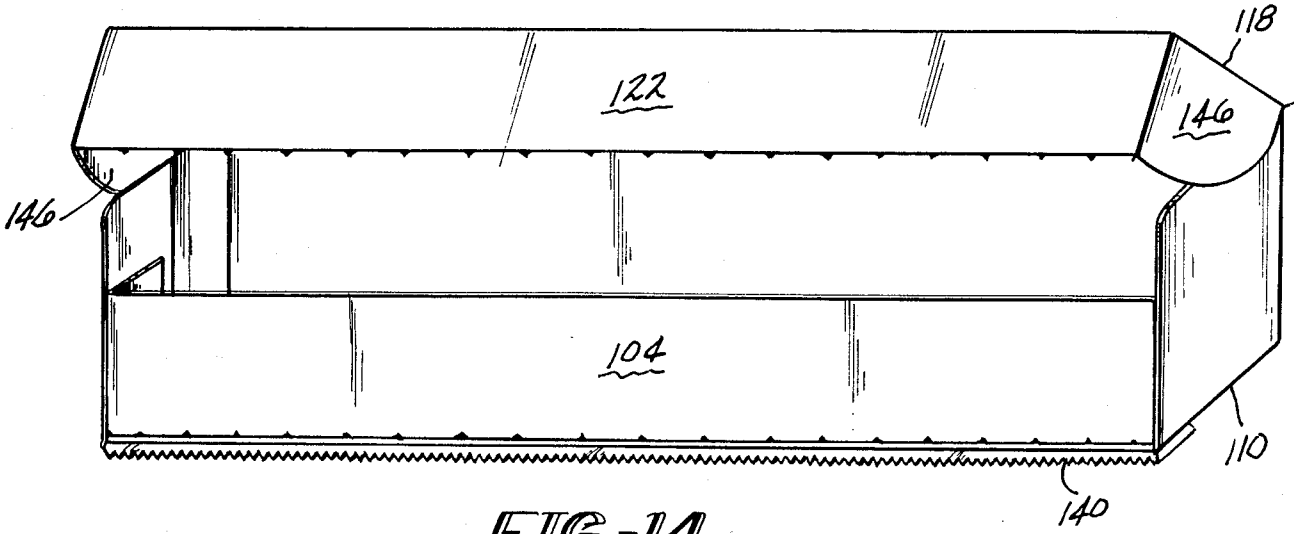
FIG. 14 is a perspective view of the carton of FIG. 13 showing the latter with the tear strip removed and the lid opened to permit withdrawal of the sheet material from a roll thereof disposed in the carton.

The carton is erected to the form shown in FIGS. 13 and 14 by folding the flattened form about the corner fold lines and by in-folding and gluing the end flaps in a known manner. It will be noted from FIG. 13 that the hood panel 122 is held in position by the tear strip 126 which, in turn, is secured to the bottom wall panel 110 by means of the adhesive flap 132. The cutting edge 138 projects beyond the plane of the front wall panel 104 and is secured to the front edge of the bottom wall panel 110 by means of the cutting edge panel 134 and adhesive flap 132.

The carton is opened to gain access to the roll of sheet material contained therein by pulling the tear strip 126 so as to rupture the interrupted cut score lines 128 and 130 thus freeing the hood panel 122 from its securement with the bottom wall panel 110. The hood panel 122, top wall panel 118 and end flaps 146 thus combine to form a cover for the carton which can be pivoted up and down about the score line 120 to open and reclose the carton. It will be appreciated that the sheet material is grasped and pulled from the roll down across the front wall panel 104 and then pulled against the serrated teeth 140 to sever the material being dispensed.

It will be readily appreciated that the carton and blank constructions disclosed are manufacturable in a manner wherein the plastic tear edge can be mounted on one edge zone of the blank prior to final cutting of the blank, and that the tear edge can be serrated along with the underlying paperboard panel during the final edge cutting operation, which operation is performed with a profiled serrated cutting instrument. The serrations on the underlying paperboard are then substantially removed from beneath the plastic serrations by skiving off about 90% of the underlying paperboard in the serrated area. The resultant carton will have a serrated cutting edge located on the bottom wall panel at the lower front corner of the carton.

Since many changes and variations of the disclosed embodiments of the invention may be made without departing from the inventive concept, it is not intended to limit the invention otherwise than as required by the appended claims.

What is claimed is:

1. A paperboard dispensing carton for holding and dispensing a roll of sheet material which, upon being dispensed, is severed into usable sheets, said carton comprising:

(a) bottom, back and top wall panels serially arranged and foldably connected to form bottom, back and top walls for the carton, said bottom wall panel having a free side edge;

(b) a compound front wall comprising an inner panel and an outer panel adhesively secured together in overlapping arrangement;

(c) a glue flap foldably connected to a side edge of one of said inner and outer front wall panels, said glue flap being adhesively secured to an inner surface of said bottom wall panel adjacent said free side edge of said bottom wall panel thereby forming a foldable connection between said bottom wall panel and said compound front wall;

(d) a hood panel foldably connected to said top wall panel, said hood panel outwardly overlying at least a portion of said compound front wall;

(e) rupturable tear means interconnecting said hood panel and one of said inner and outer front wall panels, said tear means being operable to retain said carton in a closed condition, and, upon rupture, being operable to permit said carton to be opened; and (f) cutting edge means secured to said bottom wall panel at said free side edge thereof, said cutting edge means having a material severing surface which projects beyond the plane of said compound front wall to facilitate severing of sheet material dispensed from said carton.

2. The carton of claim 1, wherein said cutting edge means is a plastic strip adhesively adhered to said bottom wall panel.

3. The carton of claim 2, wherein said material severing surface of said plastic strip is substantially free of underlying paperboard to provide a substantially all plastic severing surface for severing dispensed sheet material.

4. The carton of claim 3, wherein said plastic severing surface comprises a plurality of serrated teeth formed on said plastic strip.

5. The carton of claim 1, wherein said rupturable tear means is a tear strip connected to said hood panel by a first rupturable score line, and to said inner front wall panel by a second rupturable score line.

6. A paperboard dispensing carton for holding and dispensing a roll of sheet material which, upon being dispensed, is severed into usable sheets, said carton comprising:

(a) front, bottom, back and top wall panels serially arranged and foldably connected to form front, bottom, back and top walls for said carton;

(b) a hood panel foldably connected to said top wall panel and outwardly overlying at least a portion of said front wall panel;

(c) a glue flap adhesively secured to a front edge area of said bottom wall panel;

(d) a cutting edge panel foldably connected to said glue flap and back folded onto said glue flap and adhesively secured thereto;

(e) cutting edge means secured to said cutting edge panel, said cutting edge means having a material severing surface which projects beyond a free edge of cutting edge panel and beyond the plane of said front wall panel to facilitate severing of sheet material dispensed from said carton; and (f) rupturable tear means interconnecting said hood panel and said glue flap, said tear means being operable to retain said carton in a closed condition and, upon rupture, being operable to permit said carton to open.

7. The carton of claim 6, wherein said cutting edge means is a plastic strip adhesively adhered to said cutting edge panel.

8. The carton of claim 7, wherein said material severing surface of said plastic strip is substantially free of underlying paperboard to provide a substantially all plastic severing surface for severing dispensed sheet material.

9. The carton of claim 8, wherein said plastic severing surface comprises a plurality of serrated teeth formed on said plastic strip.

10. The carton of claim 6, wherein said rupturable tear means is a tear strip connected to said hood panel by a first rupturable score line, and to said glue flap by a second rupturable score line.

11. A paperboard blank for forming a sheet material dispensing carton, said blank comprising:

(a) a bottom wall panel having a free side edge;

(b) a cutting edge secured to said free edge of said bottom wall panel, said cutting edge having a cutting surface projecting beyond said free edge of said bottom wall panel;

(c) a back wall panel connected to an edge of said bottom wall panel opposite said free side edge by a score line;

(d) a top wall panel connected to said back wall panel by a score line;

(e) a hood panel connected to said top wall panel by a score line;

(f) a first front wall panel;

(g) rupturable tear means connecting said hood panel with said first front wall panel;

(h) a second front wall panel connected to said first front wall panel by a score line; and (i) a glue flap connected to said second front wall panel by a score line.

12. A paperboard blank for forming a sheet material dispensing carton, said blank comprising:

(a) a front wall panel;

(b) a bottom wall panel connected to said front wall panel by a score line;

(c) a back wall panel connected to said bottom wall panel by a score line;

(d) a top wall panel connected to said back wall panel by a score line;

(e) a hood panel connected to said top wall panel by a score line;

(f) a glue panel;

(g) rupturable tear means connecting said hood panel with said glue panel;

(h) a cutting edge panel connected to said glue panel by a score line, said cutting edge panel having a free side edge; and (i) a cutting edge secured to said cutting edge panel.

13. A method of forming a paperboard blank for a carton, said method comprising the steps of:

(a) adhering a plastic strip cutting edge to the paperboard;

(b) concurrently cutting said plastic strip and the underlying paperboard to concurrently form a cutting surface on said plastic strip and a free side edge on the blank; and (c) removing a major portion of the paperboard material underlying said cutting surface to improve the material severing capability of said cutting surface.

14. The method of claim 13, wherein approximately 90% of the underlying paperboard material is removed from said cutting surface.

* * * * *